US005716911A

United States Patent [19]

Furey et al.

[11] Patent Number: 5,716,911

[45] Date of Patent: Feb. 10, 1998

[54] METHOD FOR REDUCING FRICTION AND WEAR OF RUBBING SURFACES USING ANTI-WEAR COMPOUNDS IN GASEOUS PHASE

[75] Inventors: Michael J. Furey, Blacksburg, Va.; Czeslaw Kajdas, Plock, Poland

[73] Assignee: Virginia Tech Intellectual Property, Inc., Blacksburg, Va.

[21] Appl. No.: 604,889

[22] Filed: Feb. 22, 1996

Related U.S. Application Data

[60] Continuation-in-part of Ser. No. 393,394, Feb. 23, 1995, Pat. No. 5,637,558, which is a division of Ser. No. 22,741, Feb. 17, 1993, Pat. No. 5,407,601, which is a continuation of Ser. No. 604,771, Oct. 26, 1990, abandoned.

[51] Int. Cl.[6] ..... C10M 105/68; C10M 105/80

[52] U.S. Cl. ..... 508/110; 508/463; 508/479; 508/496; 508/579; 508/583; 501/134; 501/153; 501/154

[58] Field of Search ..... 252/12, 12.2, 52 R, 252/56 D, 56 S, 56 R, 49.7, 28, 25, 49.5; 508/110, 463, 479, 496, 579, 583; 501/134, 153, 154

[56] References Cited

U.S. PATENT DOCUMENTS

| | | | |
|---|---|---|---|
| 3,114,708 | 12/1963 | Morway et al. | 252/12 |
| 3,180,832 | 4/1965 | Furey | 252/56 |
| 3,208,940 | 9/1965 | Owens | 508/463 |
| 3,208,941 | 9/1965 | Owens | 508/463 |
| 3,273,981 | 9/1966 | Furey | 44/66 |
| 3,280,027 | 10/1966 | Pierre et al. | 508/463 |
| 3,287,273 | 11/1966 | Furey et al. | 252/56 |
| 3,288,715 | 11/1966 | Owens | 508/59 |
| 3,429,817 | 2/1969 | Furey et al. | 252/56 |
| 3,516,933 | 6/1970 | Andrews et al. | 252/12 |
| 3,544,466 | 12/1970 | McDowell et al. | 252/46.7 |
| 3,827,892 | 8/1974 | McCauley | 106/46 |

(List continued on next page.)

OTHER PUBLICATIONS

ASLE Transactions 5; Campbell, W.E. et al; Polymer Formation on Sliding Metals in Air Saturated with Organic Vapors; pp. 91–104 (1962).

Lauer, J., et al., *Tribology Trans.*, "Continuous High Temperature Lubrication of Ceramics by Carbon Generated Catalytically from Hydrocarbon Gases," 33 (4), pp. 529–534 (1990). month unknown.

Furey, "Formation of Polymeric Films Directly on Rubbing Surfaces to Reduce Wear," Wear, vol. 26, (1973), pp. 369–392. (month unknown).

Furey, "The In Situ Formation of Polymeric Films on Rubbing Surfaces," Proc. Int. Colloq., Polymers and Lubrication, Brest, Centre National de la Recherche Scientifique, Paric, No. 233 (1975), pp. 393–404. (month unknown).

Furey et al., "Thermal and Catalytic Effects on Tribopolmerization as a New Boundary Lubrication Mechanism", Wear, vol. 36 (1990) pp. 85–97, (month unknown).

Smith et al., "An explanatory study of vapor–phase lubrication of ceramics by monomers", Wear, vol. 181–183 (1995), pp. 581–593. (month unknown).

Furey, "Tribology", Encyclopedia of Materials Science of Engineering, Pergamon Press, Oxford, pp. 5145–15157, 1986. (month unknown).

Furey et al., "Models of Tribopolymerization as Anti–Wear Mechanism", Proc. Jpn. Int. Tribology Conf., Nagoya, Japan 1990, pp. 1089–1094. (month unknown).

NIST Special Publication 754, "Vapor Phase Deposition Studies of Phosphate Esters . . . ", Deckman et al., U.S. Dept. of Commerce, Sep. 1988.

*Primary Examiner*—Margaret Medley

*Attorney, Agent, or Firm*—Whitham, Curtis, Whitham & McGinn

[57] ABSTRACT

Method of lubricating a rubbed surface with a gaseous phase lubricant including a monomer constituent dispersed in a carrier fluid, where the monomer constituent is capable of forming in situ a polymer film directly on rubbing surfaces but is not polymerized in the carrier fluid, such that wear and friction of the rubbed surface are effectively reduced.

19 Claims, 8 Drawing Sheets

U.S. PATENT DOCUMENTS

| | | | |
|---|---|---|---|
| 3,888,776 | 6/1975 | Silverstein | 252/25 |
| 3,978,908 | 9/1976 | Klaus et al. | 164/72 |
| 4,048,370 | 9/1977 | Orkin et al. | 252/12 |
| 4,257,902 | 3/1981 | Singer | 252/18 |
| 4,462,920 | 7/1984 | Snyder, Jr. et al. | 252/75 |
| 4,469,611 | 9/1984 | Snyder, Jr. et al. | 252/75 |
| 4,484,928 | 11/1984 | Keller, Jr. | 209/5 |
| 4,497,720 | 2/1985 | Moriga et al. | 252/52 A |
| 4,543,390 | 9/1985 | Tanaka et al. | 525/63 |
| 4,551,396 | 11/1985 | Wiegard et al. | 428/678 |
| 4,617,879 | 10/1986 | Mori | 123/73 AD |
| 4,626,941 | 12/1986 | Sawada et al. | 360/97 |
| 4,650,592 | 3/1987 | Dobbs et al. | 252/12.2 |
| 4,759,860 | 7/1988 | Tanaka et al. | 252/32.5 |
| 4,789,913 | 12/1988 | Gregory et al. | 360/97.03 |
| 4,826,612 | 5/1989 | Habeeb et al. | 252/32.7 E |
| 4,994,196 | 2/1991 | Kagaya et al. | 252/32.5 |
| 5,049,291 | 9/1991 | Miyaji et al. | 252/33 |
| 5,122,502 | 6/1992 | Bowman et al. | 503/227 |
| 5,139,876 | 8/1992 | Graham et al. | 428/411.1 |
| 5,195,481 | 3/1993 | Oyama et al. | 123/196 R |
| 5,221,491 | 6/1993 | Roper et al. | 252/51.5 A |
| 5,250,081 | 10/1993 | Habeeb et al. | 44/422 |
| 5,264,005 | 11/1993 | Blythe | 44/388 |
| 5,281,346 | 1/1994 | Adams et al. | 252/38 |
| 5,304,315 | 4/1994 | Stover | 252/51.5 A |
| 5,321,172 | 6/1994 | Alexander et al. | 585/2 |
| 5,327,998 | 7/1994 | Rosado et al. | 427/248.1 |
| 5,330,667 | 7/1994 | Tiffany, III et al. | 252/49.6 |
| 5,388,561 | 2/1995 | Cullum et al. | 123/672 |
| 5,393,441 | 2/1995 | Thaler et al. | 252/51.5 A |
| 5,407,601 | 4/1995 | Fuery et al. | 252/56 S |

METHOD FOR REDUCING FRICTION AND WEAR OF RUBBING SURFACES USING ANTI-WEAR COMPOUNDS IN GASEOUS PHASE

CROSS-REFERENCE TO RELATED APPLICATIONS

This patent application is a continuation-in-part (CIP) application of the patent application having U.S. Ser. No. 08/393,394 filed on Feb. 23, 1995, now U.S. Pat. No. 5,637,558, which is a divisional patent application of U.S. Ser. No. 08/022,741 filed Feb. 17, 1993, now U.S. Pat. No. 5,407,601, which itself was a continuation patent application of the patent application having U.S. Ser. No. 07/604,771, filed Oct. 26, 1990, now abandoned. The complete contents of each of these applications is herein incorporated by reference.

DESCRIPTION

BACKGROUND OF THE INVENTION

1. Field of the Invention

The invention is generally directed to a method of reducing friction and wear of a moving, contacting surface using compositions containing monomeric compounds in gaseous phase that are capable of polymerizing directly on a moving, contacting surface under tribological conditions to function as anti-wear additives.

2. Description of the Related Art

Wear has been defined as the progressive loss of a substance from the operating surface of a body as a result of relative motion at the surface of the body (see, Furey, "Tribology", *Encyclopedia of Materials Science & Engineering,* Pergamon Press, Oxford, pp. 5145–5157, 1986). When elements rub together, whether made of the same or different materials, wear can occur. The rate of wear tends to increase under harsh temperature and pressure conditions which, for example, exist inside ceramic or metal engines, propulsion engines, and the like. In addition to limiting the useful life of the part in which the ceramic or metal is used, wear of ceramics or metals can be costly because the ceramic or metals materials themselves are expensive to produce. Other significant problems associated with wear include, e.g., down time for equipment, reduced safety, and diminished reliability.

Therefore, lubrication, particularly under boundary friction conditions, is extremely important for rubbing materials, especially those in so-called tribological systems. Tribology is a study of wear, friction, and lubrication. Tribological conditions exist whenever a surface rolls or slides over another. Such conditions can exist, for example, between metal surfaces, between ceramic surfaces, or between different types of materials (e.g., ceramic and metal).

Lubrication is a process that reduces friction and/or wear (or other forms of surface damage) between relatively moving surfaces by the application of a solid, liquid, or gaseous substance (i.e., a lubricant) (see Furey, "Tribology", *Encyclopedia of Materials Science & Engineering,* Pergamon Press, pp. 5145, 5149, 1986). Therefore, the primary function of a lubricant is to reduce friction or wear or both between moving surfaces in contact. However, lubricants can also serve other ancillary functions, such as acting as a hydraulic fluid, coolant, gas seal and carrier for adhesives; they may also protect metal surfaces from corrosion and aid in the removal of debris and deposits. Examples of conventional lubricants are widespread and diverse. They include automotive engine oils, wheel bearing greases, transmission fluids, electrical contact lubricants, rolling oils, cutting fluids, preservative oils, gear oils, jet fuels, instrument oils, turbine oils, textile lubricants, machine oils, jet engine lubricants, air water, molten glass, liquid metals, oxide films, talcum powder, graphite, molybdenum disulfide, waxes, soaps, polymers, and even the synovial fluid in human joints.

Also, the environments where lubrication needs arise continue to evolve. For instance, in machinery, the classical lubricants and additives more typically have addressed applications involving rubbing parts made of metal. However, more recently there also has been increased interest in using ceramic materials in a wide variety of applications which traditionally have utilized metals. Ceramic materials have several advantageous engineering properties. For example, ceramics generally can be used at much higher temperatures than metals, are relatively inert and resist corrosion, and are resistant to abrasive wear owing to their hardness. Additionally, some ceramics are lighter in weight than conventional steel-based materials. Alumina, silicon nitride, partially stabilized zirconia, and silicon carbide, for example, have been particularly recognized as ceramic materials that are good candidates for many tribological applications.

Ceramics thus have attracted increased interest for uses along side, in combination with, and/or in lieu of metals, such as in automotive engines, gas turbines, turbomachinery, cutting tools for super alloys, and aerospace bearings, which are driven by a need for industrial materials that can tolerate high temperature, corrosive environments and/or result in better efficiency.

In the prior art, lubrication of machine parts and the like has typically involved one of the following four strategies.

In a first strategy, various materials such as oils, additives, polymers, solid lubricants, and soaps are incorporated into the material (e.g., ceramic, composite, etc.) during manufacture. The resulting component has a "self-lubricating" property in that as the component wears away, lubricant present within the material is exposed and used for lubrication. A drawback of this first strategy is that it physically changes the properties of the component produced when compared to a component made of the same material without incorporated lubricants. More specifically, this approach typically has the problem of compromising the structural strength of the ceramic component; and the added component can undermine the high temperature performance of the ceramic. In addition, this first strategy cannot be employed in existing state-of-the-art bearings, since it requires incorporation of the lubricant at the time the bearings are made.

In a second strategy, a component receives a "surface treatment" such as ion sputtering or implantation, or the component is coated with a metallic film, polymer film, or a solid lubricant. The resulting component retains the qualities of the base material selected, but the component also includes a surface treatment which will allow the component to resist wear. The "surface treatment" approach poses compatibility and coating-to-substrate adhesion problems. It also requires component manufacturers to employ extra processing steps which slows down the rate of production of the component. In addition, the surface treatment is itself subject to the effects of wear action. Consequently, it also will wear out with time and harsh treatment, and once removed, the surface of the component will no longer be lubricated.

In a third strategy, antiwear additives are solubilized within a fuel or fluid (e.g., a mineral or synthetic oil) which is passed over the component, whereby the solubilized antiwear additive reacts with a surface of the component during use of fuel or fluid to form a low shear film. Typically, the component itself catalyzes reactions necessary to form the film. For example, this third strategy is commonly used in engine parts and like where iron phosphates, iron sulfides, or other iron compounds are formed from solubilized antiwear additives. This third strategy requires that the antiwear additive be soluble within the fuel or fluid, and requires a fairly catalytic component surface. Also, the third strategy may not be useful with certain substrates, such as ceramics and composite components, since these materials are typically less reactive than metal. Additionally, fluids containing antiwear additives according to this third strategy have shown poor oxidative and thermal stability in high temperature ranges. This produces large quantities of volatile and solid products in a conventional recirculating liquid lubricating system.

In a fourth strategy, fluid dispersed solid lubricants such as graphite or molybdenum disulfide are applied to the surfaces of rubbing components. Solid lubrication techniques typically require high concentrations of lubricant, which may be disadvantageous in many applications. Furthermore, solid lubrication techniques are subject to oxidation, and dispersion settling and filter plugging problems.

From a traditional engineering point of view, the emphasis has been focused more on use of physical attributes of the lubricant substances and not exploiting any intrinsic chemical reactivity of the lubricating substance during tribological conditions. However, more recently, other approaches involving lubrication of materials from the gas or vapor phase have been suggested. These techniques include:

(i) Vapor phase deposition of tricresyl phosphate (TCP), and (ii) Surface-generated carbon from gaseous ethylene.

A mode of ceramic lubrication by vapor phase deposition of TCP is based on the method originally developed by Klaus and Lai (U.S. Pat. No. 3,978,908), a method in which phosphate ester, especially TCP, is vaporized and the vapors/mists are passed through heated tubes in a carrier gas to bring them to the hot friction surfaces, previously coated with $Fe_2O_3$, where they react to form solid lubricating product referred to as a polymer film. The Klaus et at. method has been applied to lubricate a stainless steel die casting as well. However, phosphorus compounds tend to leave deposits in a combustion chamber of an engine, or interfere with the action of emission catalyst systems.

Another approach to ceramic lubrication is described in U.S. Pat. No. 5,139,876 (Graham et at.) which encompasses two basic aspects. The first aspect concerns a chemical activation process, i.e., taking a ceramic and chemically activating it or treating it with an organic metal compound. The second aspect deals with forming a lubricating film on the ceramic after it has been treated. Chemically activating the ceramic refers to putting a layer of a metal ion on its surface. After the ceramic is given a metal coating, either tricresyl phosphate or other phosphate esters are used as lubricating agents. Without the special precoating, however, the ceramic surface cannot accept the lubricating agent. That is, it is a drawback of such vapor phase lubrication techniques for ceramics of Graham et al. in that an $Fe_2O_3$ or iron-containing pre-coating upon the ceramic must be provided by treating the ceramic surface with ferric acetylacetonate. The $Fe_2O_3$ or iron-containing pre-coat, however, is difficult to replenish. Another drawback is that the oxygen content in the carrier gas seems to be a factor controlling the lubricating film formation from TCP degradation products.

As a different proposal for gas phase lubrication, surface-generated carbon from gaseous hydrocarbons has been demonstrated by Lauer and Dwyer (*Tribology Trans.*, 33 (4), pp. 529–534 (1990)). It has been shown that ceramics such as alumina, can be coated with nickel/nickel oxide and thus catalyze decomposition of gaseous hydrocarbons on the wear surface to produce a carbonaceous lubricating soot at high temperatures. Thus, the Lauer and Dwyer approach generally concerns high-temperature lubrication of ceramics (350° to 650° C.). A hydrocarbon gas is injected to the hot friction surfaces, e.g., alumina coated with nickel/nickel oxide, where on hot solid friction surfaces it decomposes catalytically (nickel catalyst) generating a carbonaceous lubricating soot. Therefore, Lauer and Dwyer degrade a hydrocarbon gas to form a decomposition product, i.e. carbon soot, only in discrete particulate form. Lauer and Dwyer also describe a step of pre-coating the ceramic surfaces; that is, either by $Fe_2O_3$ film or by nickel/nickel oxide film, in order to activate the ceramic surface. Such precoats have a finite life and inevitably will be worn away after a given time in service.

None of the prior art approaches discussed above is satisfactory for lubricating wear surfaces in challenging environments (e.g., very high temperatures), nor versatile enough to lubricate a variety of different surfaces, such as ceramics or metals, without serious limitations or burdens in their implementation, and a new approach to reducing friction and wear which overcomes these and other shortcomings of the prior art would be highly desired by industry. Moreover, none of the prior art approaches discussed above synthesize surface polymer lubricants in situ at the rubbing boundary regions of rubbing surfaces to provide an ashless, biodegradable lubricant which reduces environmental concerns and will not foul a catalyst of a catalytic converter used in conjunction with a combustion engine.

SUMMARY OF THE INVENTION

It is therefore an object of the present invention to provide a method for lubricating contacting surfaces under tribological conditions via introduction of monomer compounds in gaseous phase to the contact region to form lubricating surface polymers. It is a further object of the invention to provide a method for lubricating such contacting surfaces which does not require any special advance surface treatment or preparation of the contacting surfaces.

According to one embodiment of the invention, experiments have been conducted which show that gaseous compositions containing certain monomers which are capable of forming polymers when subjected to adverse tribological conditions, such as high temperature, pressure, and friction, can significantly reduce the amount of wear of rubbing elements.

In a further embodiment of the invention, contacting rubbing surfaces are continuously lubricated with a gaseous composition containing the monomer compounds as a relatively small fraction thereof, and the balance being represented by a carrier fluid. These monomers have been found to be adaptable to introduction to the contact region by the present inventors via a gaseous type of fluid medium (carrier). By a standard definition, a "fluid" is any material or substance that changes shape or direction uniformly in response to an external force imposed upon it, and, as such, the term applies not only to liquids, but to gases as well, as universally understood in the scientific arts. For purposes of this invention, "gaseous" means, consistent with a standard definition thereof, a state of matter characterized by very low density and viscosity (relative to liquids and solids), comparatively great expansion and contraction with changes in pressure and temperature, ability to diffuse readily into other gases, and ability to occupy with almost complete uniformity the whole of any container. Moreover, the gas phase includes vapor forms thereof. The term "vapor" means a gaseous substance which is at a temperature below its critical temperature. In a preferred embodiment, vapors used in the present invention involve a dispersion within a gaseous medium of molecules of an organic monomeric substance that is a liquid in its normal state, i.e., at standard temperature and pressure. For instance, in the present invention, the monomer compounds, when used in the vapor phase, are used at partial pressures below their saturation pressure at the operating temperature/pressure, and thus no condensation (liquid phase) of the monomers occurs. Consequently, the term "vapor" should be construed as being subsumed to the meaning of the term "gas" for purposes of this invention.

While the mechanism by which the monomers reduce wear is not precisely known, there is positive evidence of polymer film formation "in situ" on the surfaces of the elements which rub against one another. The key protecting feature conferred by the gaseous fluid composition is in the "in situ" polymerization of the monomers adsorbed on the surface of the ceramic or metal element under tribological conditions. Adsorption is the process by which a monomer is concentrated at a rubbing surface, e.g., a ceramic or metal surface, as applicable, and it is likely that physisorption or chemisorption could be involved.

In one further aspect of the invention, there is the gaseous phase lubrication of a ceramic or metal tribological system by in situ formation of polymers based on the concept of tribopolymerization as a mechanism of boundary lubrication. For purposes of this application, "tribopolymefization" is defined as the planned and intentional formation of protective polymeric films directly and continuously on surfaces in tribological contact to reduce damage and wear from monomers capable of forming polymeric films in situ. The polymer-forming monomers can be introduced to a contact region in gaseous phase through a variety of different carrier gases and can reduce wear under the severe conditions of boundary lubrication. Prior surface treatment of the rubbing surfaces in the contact region is not required in the present invention in order to achieve the inventive anti-wear effect imparted by the gas phase lubricant according to the invention.

Selected monomer compounds are introduced into a gaseous carrier fluid for adsorption on contact regions of the ceramic or metal surface. "In-situ" polymerization of the monomers is triggered by the tribological conditions that exist due to rubbing to form a thin protective film of polymerized material. As the formed polymer film wears away, it is replenished continuously as long as fresh monomers are supplied to the contact regions in gas form. The polymer films formed are localized surface polymers, and, as such, are restricted to the contacting regions of the rubbing surfaces; they do not form in the bulk carrier fluid nor do they form in noncontacting regions of the rubbing surfaces. The polymer film thus formed results in a marked reduction of friction and wear of the surface of the rubbing elements, e.g., ceramic and/or metal elements.

The function of the gaseous carrier fluid is to transport the monomer compounds onto the surface of the ceramic or metal element. Therefore, any suitable gaseous carrier fluid, such as air, nitrogen gas, fossil fuel or other hydrocarbon combustion gases, and so forth, for gas phase introduction of the monomers to the contact region, is deemed to be within the scope of the invention. Gaseous carrier fluids for the monomers should be selected with proper volatility, boiling point, chemical reactivity, and so forth, for the specific application. Preferably, the carrier gas is chemically inert under conditions experienced in the contact region of the rubbing surfaces. To avoid adversely affecting other properties of the fluid composition and as a matter of cost, the concentration of the monomer compounds in the overall gas composition should generally be limited to a range of about 0.001 to about 0.02 g/l (i.e., about $0.3\times10^{-5}$ to about $8.0\times10^{-5}$ moles/l).

At any rate, one class of monomers useful in this invention are compounds including an unsaturated ethylenic unit, and it is fairly surmised that the polymerization itself of the adsorbed monomers proceeds via a classical addition mechanism in this instance. Monomer compounds in the addition category according to the present invention include an unsaturated ethylenic unit such as generally shown below in Formula 1:

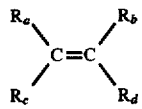

Formula 1 where the R groups are either hydrogen or some other group such as described herein. Particularly effective monomers for reducing ceramic or metal wear are those in which $R_a=R_b=R_c=H$ with $R_d$ being an aliphatic, aromatic, cyclic, or some other group containing an oxygen and/or nitrogen atom. Having only one non-hydrogen group may avoid steric hindrance problems and favor surface polymerization. By conventional definition and for purposes of this invention, polymerization by "addition" mechanism means free radicals act as initiating agents that react with a double bond of a monomer by adding to it on one side, at the same time producing a new free electron on the other. The addition polymerization mechanism can be generally represented as follows: $R^*+CH_2{=}CHX \rightarrow R{-}CH_2{-}CHX^*$ where R* is a free radical, anion, or cation. By this mechanism, the chain becomes self-propagating.

A useful class of monomers in this regard for this invention have the following general formula (I):

$$CH_2{=}C(R_1)R_2 \qquad (I)$$

where $R_1$ may be H, $CH_3$ or $C_2H_5$, while $R_2$ is an organic alkyl or aryl radical containing from 1 to 24 carbon atoms with the proviso that $R_2$ can include at least one oxygen and/or nitrogen atoms. Monomeric compounds within the scope of formula (I) include: (a) alkyl methacrylates (e.g., butyl, hexyl, lauryl, octadecyl methacrylates); (b) alkyl acrylates; (c) vinyl esters (e.g., vinyl acetate, vinyl propionate, vinyl octoate); (d) vinyl alkyl ethers (e.g., vinyl hexyl ether, vinyl octadecyl ether); (e) allyl esters of alkyl and aryl acids; (f) divinyl and diallyl analogs of the above compounds (e.g., diallyl sebacate, diallyl phthalate); (g) trivinyl and triallyl analogs of the above compounds (e.g., triallyl trimesate); and (h) compounds in which $R_2$ contains no oxygen (e.g., 1-octadecene and vinyl ferrocene).

In another embodiment, monomer compounds that form polymers by condensation type reactions, as defined in U.S. Pat. No. 5,407,601 (Furey et al.) and incorporated herein by reference, can also be used in this invention.

The substrates that can be lubricated by the inventive method are not particularly limited, and include, for example, ceramics, composites, and metals. The rubbing surfaces can involve two (or more) contacting surfaces of solid materials, where the contacting surfaces are in relative motion to each other. For example, confronting surfaces of two separate solid bodies can both be moving in sliding contact one over the other, or, alternatively, one surface can be stationary while another surface of another body is set in motion to slide in contact over the surface of the stationary body. Also, the inventive method can be used to lubricate a plurality of ceramic surfaces in rubbing contact, a plurality of metal surfaces in rubbing contact, or both a ceramic surface and a metal surface in rubbing contact. Ceramic materials that can be lubricated by the invention include, for example, alumina, zirconia, silicon nitride, silicon carbide, boron nitride, aluminum nitride, boron carbide, beryllia, and combinations thereof. Metals that can be lubricated by the invention, include, for example, steel, alloy steels, alloy cast iron, aluminum alloys, titanium alloys and other advanced high-strength, high temperature, metallic alloys. Composites (e.g., graphite- or fiber-reinforced resins) also can serve as a substrate to be lubricated by the invention.

The use of the monomers in the tribopolymerization concept of boundary lubrication brings about extraordinary reductions in ceramic or metal wear when used at low concentrations in gas fluid phase. The inventive method is especially useful for providing lubrication in high temperature systems, such as high temperature engines. Moreover, in the gas phase delivery scheme according to the present invention, it is surprising that the beneficial anti-wear properties become even more pronounced at higher vapor delivery temperatures. Further, no special treatment or pre-coating of the ceramic or metal surface destined to experience rubbing contact is necessary for the anti-wear and anti-friction action of these compounds in the gas phase.

Also, the method of the present invention has the additional advantage that monomer compounds useful as the anti-wear additive are biodegradable and devoid of deposit-forming metals, phosphorus, or sulfur, which could lead to deposits in a combustion chamber of an engine, or interfere with the action of emission catalyst systems (in the case of metal and phosphorus deposits). Moreover, any non-polymerized monomer or worn away polymeric product portions thereof that are ultimately combusted in a high temperature environment, such as in a combustion chamber of an engine, form ashless, gaseous combustion products (e.g., water, carbon dioxide), and, as such, pose no threat to foul the catalyst in a catalytic converter and pose reduced environmental concerns.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
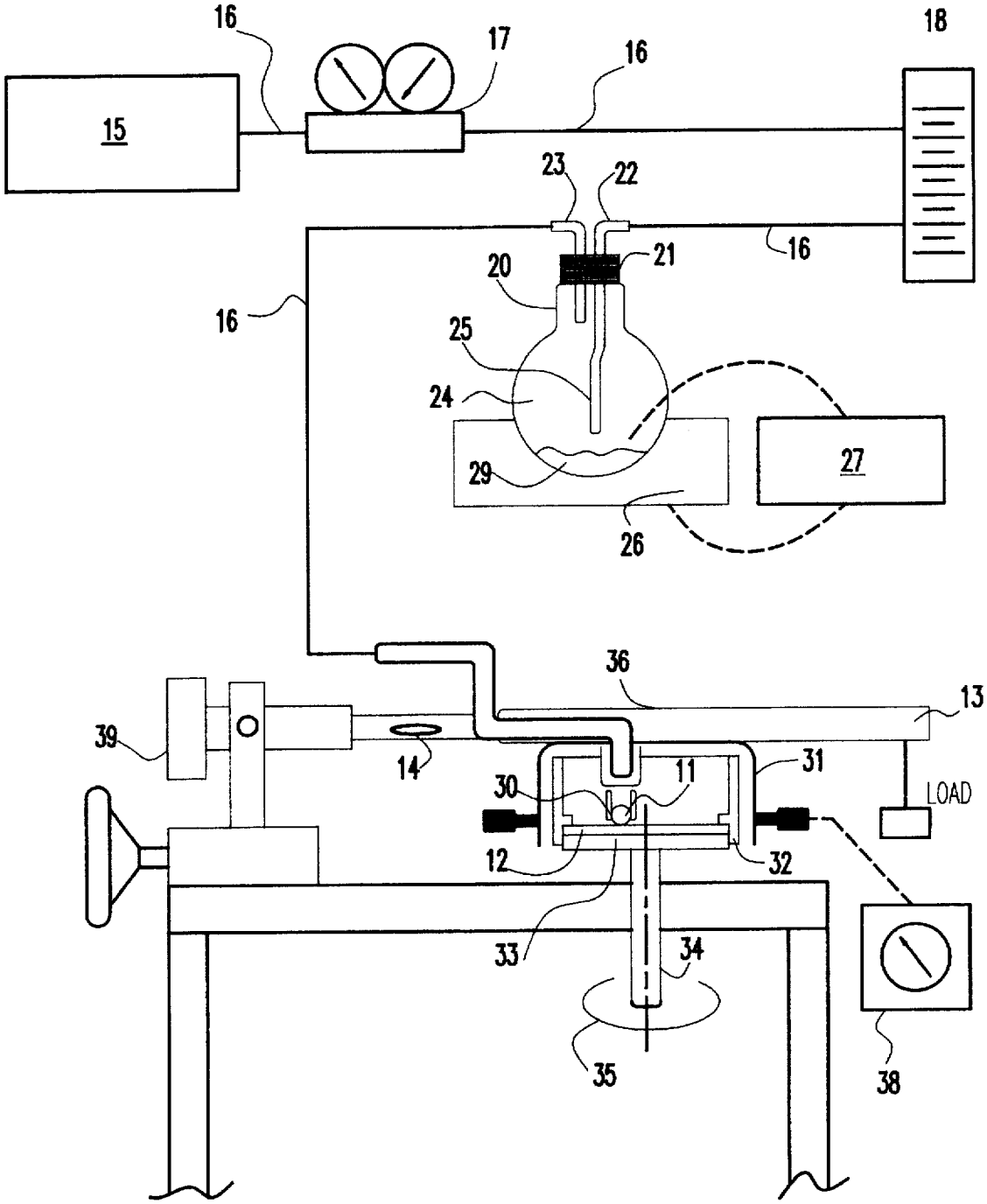
FIG. 1 is a schematic drawing showing the basic contact geometry and diagram of the experimental vapor phase apparatus.

The invention described herein involves reducing wear in rubbing surfaces by introduction of a monomer additive in gaseous form to the contact region where the monomer polymerizes in situ directly on rubbing surfaces in the contact region. The inventive method has utilization in continuous, open flowing systems, e.g., as in a high temperature engine operating with ceramic, metal, or composite components, singly or in combinations thereof. However, the gaseous mixture could also be recycled and re-introduced to the region of sliding contact. It can also be applied to both a sealed system requiring low wear/low friction operation. The method will ensure a continuous formation of protective surface films to reduce wear and friction.

This technique of lubricating a solid surface at high temperatures does not require any special surface treatment in advance (e.g., the pre-coating of the ceramic or metal with either a catalyst to promote certain types of film-formation or with a metal or organometallic film which allows the system to respond to anti-wear additives designed to function with steel). Such approaches have the inherent and fundamental disadvantage that when the pre-coatings are worn off, the protective mechanism can no longer operate.

The inventive method leads to the continuous formation and replenishment of protective films in a self-regenerating mode in the absence of any special surface treatment. It is also possible that in some cases, films formed in our method can offer protection for a period of time even after the vapor is no longer in contact with the rubbing surfaces. This would depend on the durability of the film formed as well as conditions of load, speed, etc.

The present invention, in this embodiment, relates to a method for reducing wear of a ceramic surface or ceramic surfaces which comprises contacting said ceramic surface(s) with gaseous lubricants containing monomer compounds which tribopolymerize under tribological conditions when introduced to a contact region of rubbing surfaces in gaseous phase. A useful class of monomers in this regard for this invention have the following general formula (I):

$$CH_2{=}C(R_1)R_2 \qquad (I)$$

where $R_1$ may be H, $CH_3$ or $C_2H_5$, while $R_2$ is an organic alkyl or aryl radical containing from 1 to 24 carbon atoms with the proviso that $R_2$ can include at least one oxygen and/or nitrogen atoms. Compounds within the scope of formula (I) include: (a) alkyl methacrylates (e.g., butyl, hexyl, lauryl, octadecyl methacrylates), (b) alkyl acrylates, (c) vinyl esters (e.g., vinyl acetate, vinyl propionate, vinyl octoate), (d) vinyl alkyl ethers (e.g., vinyl hexyl ether, vinyl octadecyl ether), (e) allyl esters of alkyl and aryl acids, and (f) divinyl and diallyl analogs of the above compounds (e.g., diallyl sebacate, diallyl phthalate); (g) trivinyl and triallyl analogs of the above compounds (e.g., triallyl trimesate); and (h) compounds in which $R_2$ contains no oxygen (e.g., 1-octadecene and vinyl ferrocene). All the above classes of compounds in above-mentioned groups (a)–(g) have the $CH_2{=}C(R_1)R_2$ structure, and the compounds preferably contain at least one oxygen atom.

Preferred compounds of general formula (I) are organic vinyl and allyl compounds used in a vapor form in a carrier gas (e.g., nitrogen, air, or exhaust gases from gasoline, diesel or jet engines) to reduce wear. More preferably, monomer compounds for the present invention within the scope of general formula (I) include methacrylates, acrylates, allyl esters, vinyl esters, and vinyl alkyl esters.

The carrier gas is defined as the predominant constituent and gaseous medium to which the formula (I) anti-wear compounds are added at relatively low concentrations. The carrier gas can be, for example, air, nitrogen, or exhaust gases from gasoline, diesel or jet engines. The carrier gas is selected as that which does not react with and is thus inert, in a limited sense, relative to the formula (I) anti-wear compounds and it plays no part in their function other than to assist in their delivery to designated contacting regions on ceramic surfaces needing lubrication, thus "carrying" the additives in the gaseous phase.

The useful concentrations of the formula (I) compound as dispersed in the carrier gas generally range from 0.001 to 0.02 g/l of gas (or approximately $0.3\times10^{-5}$ to $8.0\times10^{-5}$ moles/l of gas). Higher concentrations of the formula (I) compound may also be useful, with the upper concentration limits being those which would produce saturated vapor at a given pressure and temperature. The lower limit on the concentration generally will be that amount sufficient to form a tribopolymerized film on the contacting region of the rubbing surfaces, whether ceramic, metal and/or composite materials, that is adequate to impart wear and friction reduction effects. While it is preferred to use a concentration of monomers sufficient to form a continuous polymer film on the contacting region, e.g., of about 10 to about 100 monolayers thick, it is also contemplated that the polymer film could be formed discontinuously on the contacting region as long as wear and friction reductions are still realized, which can be empirically assessed such as by tests described herein.

These monomer compounds may be introduced into the carrier gas in a number of different ways, for example:

(a) heating the compound externally to form a vapor and then introducing the vapor into a flowing stream of inert gas (e.g., nitrogen);

(b) injecting the compound in liquid form into a stream of carrier gas so the vaporization thereof will occur. For example, the compound can be injected in liquid form into a stream of air delivered to: (i) diesel engine compression chambers; (ii) gasoline engine compression chamber with a fuel injection system; (iii) any type of engine designed to operate at high temperatures (e.g., engines with metal and/or metal alloy parts, and also adiabatic or low heat-rejection engines using ceramic components);

(c) injecting the compound in liquid form directly into an engine compression chamber during the compression cycle where vaporization of the compound occurs; and (d) any technique of adjusting pressure and temperature of the compound and carrier gas which results in the compound being present as a vapor in the mixture. These modes of gas phase application of the monomers are applicable to any of ceramic, composite, and metal surfaces, especially those operated at high temperatures.

The monomer delivery temperatures covered by this invention range from room (e.g., about 20° C.) to 500° C., with many applications being below 360° C. The temperature of the carrier gas and monomer can be regulated, for example, by passing the carrier gas through a heated flask or vessel containing liquid monomer that is being volatized by application of heat under thermostatic control; once the carrier gas picks up volatized monomer vapor in the flask it can be transmitted by conduits/tubes to a tube opening positioned proximate the contacting (rubbing) region of the surface or surfaces in contact. The monomer can be delivered to the surface areas of one or both of the solid bodies where rubbing will occur or is occurring between the two (or more) solid bodies. The actual compound vapor delivery temperatures to be used in practice will depend on the desired final vapor concentrations as well as the vapor pressure-temperature properties of the selected anti-wear/anti-friction compound. For example, a lower molecular weight, lower boiling point compound can be introduced as a vapor at a lower temperature than a higher molecular weight compound. Measurements of vapor flow, weight change of the vapor source, or vapor concentration can be made in order to regulate the desired vapor concentration. It has generally been found that delivering the vapor at a higher temperature is preferred.

The present invention is remarkably effective, as seen by as great as 99% wear reductions in alumina-on-alumina systems tested on a pin-on-disk machine as effected by use of selected monomers in the gas phase using nitrogen carrier. Further, the inventive anti-wear effects is observed in some cases to improve with increasingly higher temperatures, which phenomenon seemingly is counter-intuitive.

Although the method of the present invention can be applied to a sealed system requiring wear/low friction operation, the invention is thought to be equally applicable to continuous, open flowing systems, e.g., as in a high temperature engine operating with ceramic components, metal components, composite components, or combinations thereof. The gaseous mixture also can be recycled and re-introduced to the region of sliding contact.

Other applications of the invention include its use in lubricating high temperature alloys and metals as well as to virtually any high temperature process where surfaces rub. The use of the present invention at high temperatures does not require any special advance surface treatment for the ceramic (e.g., no need for pre-coating of the ceramic with a catalyst, metal, or organometallic film). Indeed, the present invention, in general, leads to the continuous formation and replenishment of protective films in a self-regenerating mode in the absence of any special surface treatment.

It is also possible in some circumstances for the tribopolymerized films formed by the present invention to offer anti-wear protection that persists for a period of time after the vapor is no longer in contact with the rubbing surfaces. This circumstance will depend on the durability of the film formed as well as the intensity of the rubbing conditions of load, speed and the like.

Also, the lubrication method and anti-wear compounds of this invention have the advantage in that the lubricating compounds are completely or substantially organic and devoid of metals, phosphorus, sulfur, and the like which can lead to solid residues and deposits in a combustion chamber or interfere with the action of emission catalyst systems. Instead, the lubricating compounds used in the present invention are completely combustible to form only gaseous combustion products (e.g., $H_2O$, $CO_2$). Therefore, the lubricating compounds of the invention are well-suited for use as a fuel additive for diesel engines, jet engines, high-temperature air-cooled engines, two-stroke ceramic engines, and so forth. That is, the lubricating compounds described herein, as used as a fuel additive, can form an ashless, lubricating surface coating in a combustion engine.

The following non-limiting examples demonstrate the gas phase application of the monomers to rubbed surfaces to reduce wear and friction therebetween.

EXAMPLES

Experimental Method Used

The Test Apparatus

Vapor phase lubrication experiments were performed on ceramic surfaces using a pin-on-disk machine in conjunction with a system for delivering monomers in vapor phase. The basic contact geometry and diagram of the test apparatus is shown in FIG. 1. This setup includes, as one subsystem thereof, a fixed spherical test specimen or "ball" 11 loaded against a rotating sample disk 12 as part of a pin-on-disk machine such as described in U.S. Pat. No. 5,407,601 (Furey et al.), which description is incorporated herein by reference.

Normal loads were applied by dead weights W hung from the end of the load arm 13. A strain ring 14 attached to this load arm 13 was used in conjunction with a strain indicator (not shown) and a chart recorder (not shown) to continuously measure and record friction force. Dry nitrogen gas provided from a supply 15 was used as the carrier fluid for the monomer compounds tested. TYGON tubing 16 was used for all flexible gas connections. Gas flow was controlled by a flow/pressure regulator 17 in conjunction with an in-line flow meter 18 (1000 ml/min maximum).

The compounds were vaporized using a vacuum trap type arrangement 20. A ground glass stopper 21 with one inlet 22 and one exit 23 was used in conjunction with a 100 ml boiling flask 24. The inlet nitrogen gas flow was dispersed into the boiling flask 24 through a glass diffuser 25.

A liquid sample 29 of each type of monomer compound tested was heated in a boiling flask 24 order to increase vapor pressure and thus concentration in the nitrogen carrier gas. Temperatures were raised and controlled using an insulated flask heater 26 in conjunction with a temperature controller 27 and a standard chromel/alumel thermocouple 28 immersed in the fluid. The nitrogen/compound gas mixture exited through the exit tube 23 in the top of the stopper 21 was then delivered directly to the dynamic contact region 30.

The contact region was enclosed with a stationary glass cover 31. The cover 31 was designed to minimize the clearance between itself and the cylindrical disk holder 32 holding sample disk 12 onto platform 33 of table 34. Minimizing this clearance was necessary in order to insure a positive flow of gas out of the contact region 30. Minimal clearance provides for maximum fluid velocity leaving the contact region 30. The table 34 is capable of rotation at high speeds about an axis indicated by arrow 35. The speed of rotation can be accurately regulated by a motor controller (not shown).

The glass tube 36 carrying the gaseous mixture was positioned directly above and behind the experimental contact region; this way, the vaporized compounds entered the contact region 30 from above the surface of rotating disk 12 just before contact with the ball 11.

The bulk temperature of the contact region was raised in order to prevent any condensation on the surface of the test specimens. This was accomplished using a flat ring-shaped resistance heater 37 and a variable voltage transformer or "Variac" 38. Bulk temperatures attained with this setup were calibrated according to the dial gauge rotation of the Variac. A positioning micrometer 39 was sued to laterally position the ball 11 on the ceramic material disk 12.

Materials

Alumina ($Al_2O_3$) balls and disks were used for the friction and wear tests described in this study. The disks were 25.0 mm in diameter and 3.2 mm thick and were obtained from 99.5% isostatically pressed alumina as supplied by LSP Industrial Ceramics, Incorporated. Disk surfaces were ground to a 0.5–0.65 micrometer average surface roughness. Grade 5 alumina balls, 99.5% pure and 3.2 mm (⅛ inch) in diameter were obtained from Sapphire Engineering, Incorporated.

All alumina disks and alumina balls were cleaned prior to use in an experiment. Several samples were cleaned simultaneously in successive 20 minute ultrasonic baths of hexane, methanol, and deionized water. Samples were then dried in a vacuum oven at 150° C. for two hours. Disks and balls were stored in a desiccator until use.

Compounds Tested

In all of the tests conducted, pure dry nitrogen gas was chosen as a carrier fluid for the compounds tested. Dry nitrogen was selected for its inertness. Nitrogen/compound vapor was introduced into the enclosure at 1000 ml/min to provide a controlled atmosphere in the contact region and insure a positive pressure flow out of the glass enclosure.

Data are presented on the anti-wear and anti-friction effects of four examples of monomer compounds of general formula (I). Their chemical names and structures are shown below.

Lauryl methacrylate:

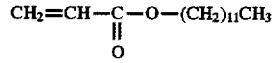

Diallyl phthalate:

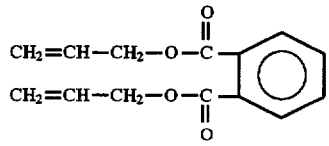

Vinyl octadecyl ether:

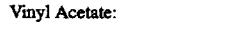

Vinyl Acetate:

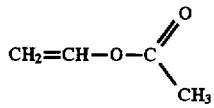

Experimental Procedure

The test conditions used are summarized in Table 1 below.

TABLE 1

Vapor Phase Experimental Setup and test conditions

| | |
|---|---|
| System | Alumina-on Alumina |
| Geometry | Sphere on Flat (Fixed Ball on Rotating Disk) |
| Specimen Size | 3.2 mm (⅛ inch) Ball on 25 mm (1 inch) Diameter Disk |
| Lubricants | Vapor of selected compounds in dry nitrogen gas |
| Lubricant delivery temperature | variable |
| Applied load | 5N |
| Sliding velocity | 0.25 m/s |
| Sliding distance | 500 m |

TABLE 1-continued

| Vapor Phase Experimental Setup and test conditions | |
|---|---|
| Ambient temperature | 20° C. |
| Bulk temperature | Variable (20–145° C.) |
| Relative humidity | 0% (dry nitrogen) |

These conditions were selected for a number of reasons. First of all, they represent severe conditions which lead to high contact stresses and wear. A 5 N load was chosen based on previous experience with dry alumina-on-alumina sliding contacts. In previous pilot tests, higher loads caused the alumina ball to loosen in its holder and spin.

To begin a test, the radius of the contact was set using the micrometer dial load arm positioning mechanism. In order to insure a constant 0.25 m/s sliding speed, the rotational speed was set according to the radius of the contact using a Strobotac. The desired 500 meter sliding distance would be reached in a test duration of 33 minutes, 20 seconds.

The 100 ml boiling flask was filled with a small amount of a compound and weighed. The minimum weight of a compound placed in the flask prior to an experiment was approximately 12 grams (enough to immerse the thermocouple). After weighing, the flask was put into place.

Elevated bulk temperatures were necessary for this work primarily due to the high molecular weights and low volatilities of the compounds tested. In order to create significant concentrations in the carrier fluid, the compounds had to be heated to temperatures approaching their boiling points. Experience showed that condensation formed rapidly on test surfaces as well as on the surrounding structures when high temperature monomer vapors were introduced to an ambient bulk temperature environment. Elevated bulk temperatures were necessary to eliminate condensation and insure vapor delivery. Indeed, this was the case; no physical evidence of condensation was found during any of the experiments.

The nitrogen/compound vapor mixture was allowed to purge the contact region for 10 to 15 seconds prior to ball/disk contact. After this purge, the motor was started and the ball was loaded against the rotating disk. The tests were timed using a digital stopwatch for the 33 minutes and 20 seconds necessary to reach the standard 500 m sliding distance at a sliding speed of 0.25 m/s.

The experimental compounds were weighed inside the boiling flask before and after each experiment to determine weight loss and thus average concentration in the carrier fluid. Weight measurement was performed using a balance with accuracy to 0.0001 gram. The average vapor concentration was calculated from the mass of compounds transported in the vapor and the volume of nitrogen gas allowed to pass through the contact region (1000 ml/min for 33 minutes, 20 seconds).

Worn surfaces were examined using a photomacroscope device. The device had a binocular tube that is used to view the sample with a maximum 80X magnification. SEM photographs were also taken to confirm visual observations taken by the device.

After the materials had cooled enough to be removed, the ball specimen was examined first. The flat, nearly circular wear scar was measured across its major and minor diameters under the photomacroscope at an appropriate magnification and then averaged to give an approximate scar diameter. Wear volume lost from the ball was calculated using a simple mathematical expression for the volume of a spherical segment. Balls were carefully removed from the holder and stored for later inspection or analysis.

Worn disk surface profiles were studied and recorded using a profilometer. Charts of various magnifications were recorded in order to determine disk wear volume. Four separate traces across different sections of the wear scar were taken and their magnifications noted. Disk wear volume could be determined by integrating and determining the area between each curve (wear scar profile) and the zero plane (original unworn plane of the disk surface). Averaging these wear scar cross-sectional areas, the total volume of material removed or worn was calculated by multiplying the area and the track length (circumference).

RESETS OBTAINED

Ball Wear Reduction

Figure 2:
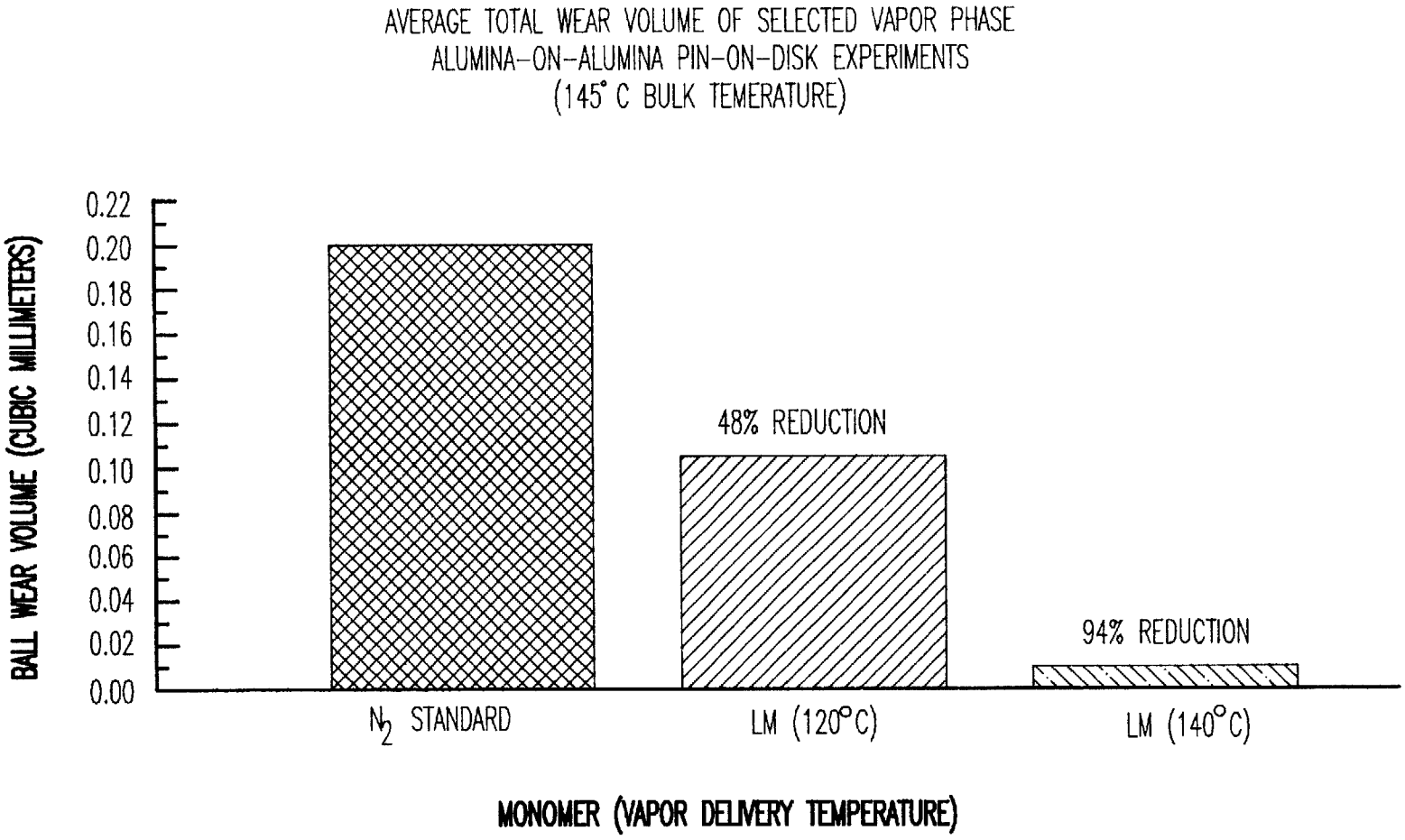
FIG. 2 is a chart of lauryl methacrylate vapor phase ball wear.
Figure 3:
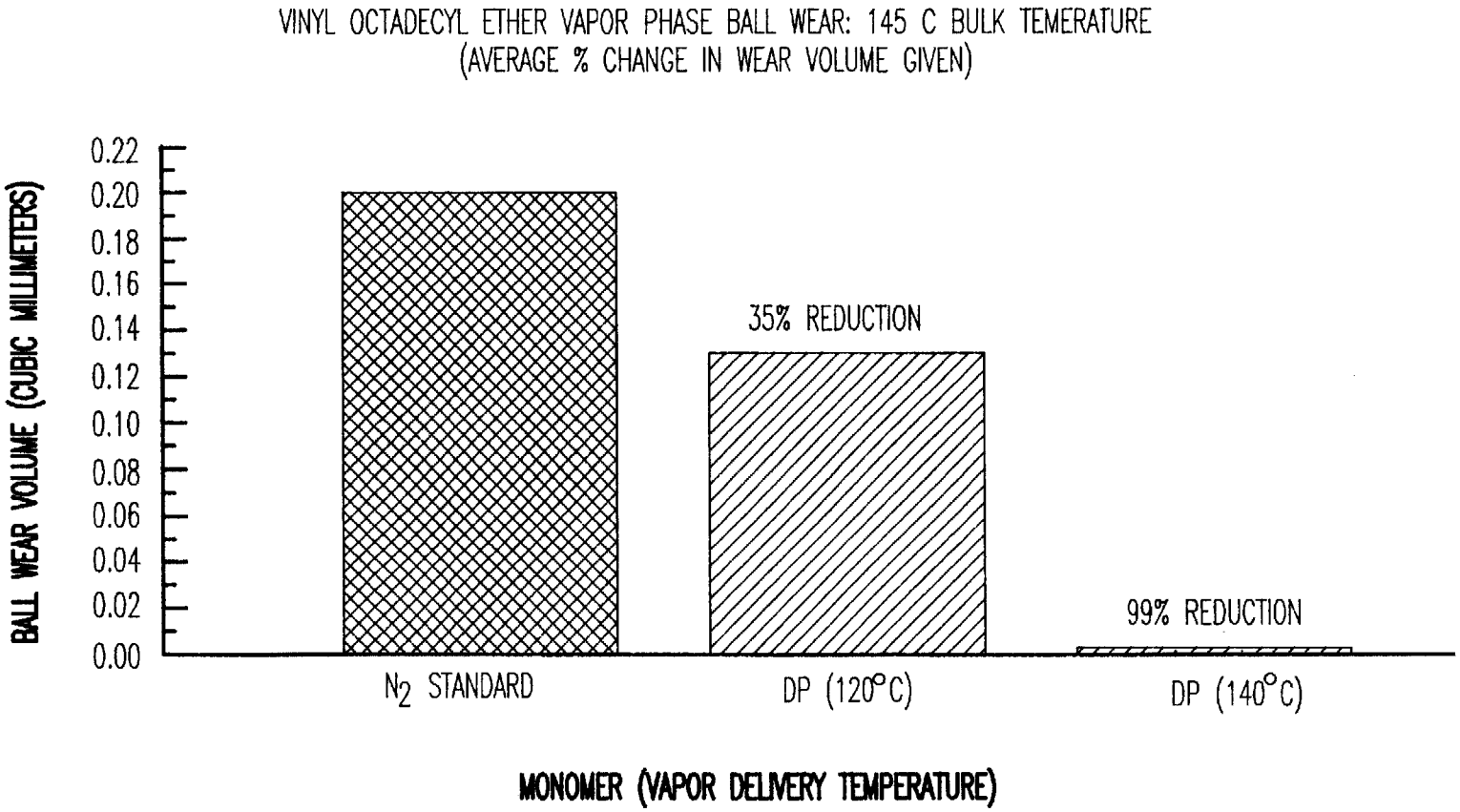
FIG. 3 is a chart of diallyl phthalate vapor phase ball wear.
Figure 4:
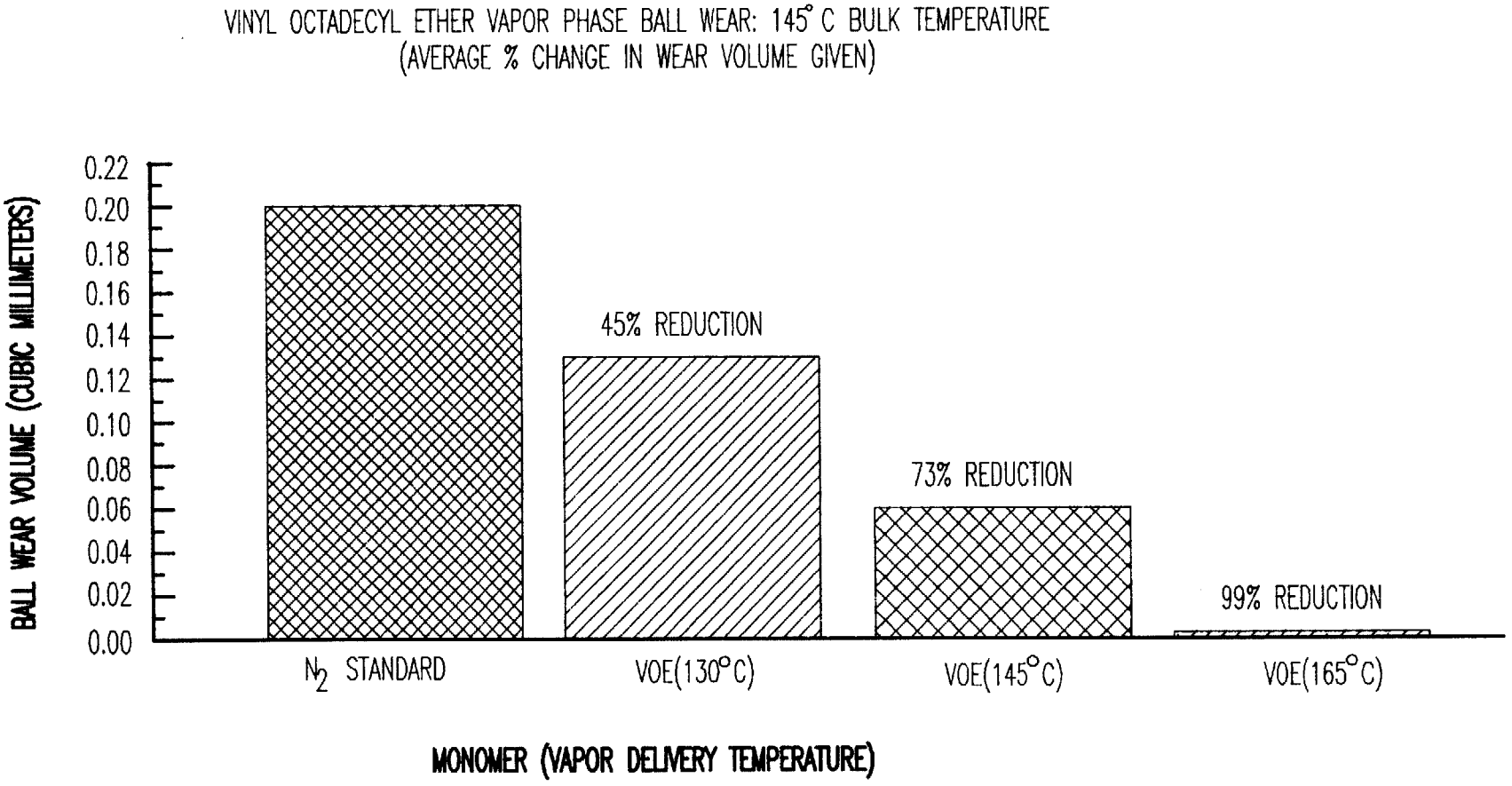
FIG. 4 is a chart of vinyl octadecyl lauryl methacrylate vapor phase ball wear.

Examples of ball wear results for the alumina-on-alumina elevated bulk temperature (145° C.) treatments for three of the tested monomeric compounds examined in the gas phase tests, viz., lauryl methacrylate ("LM"), diallyl phthalate ("DP"), and vinyl octadecyl ether ("VOE"), are summarized in FIGS. 2–4. The temperatures of the various monomeric compounds were raised to the temperatures indicated in these figures for the duration of the experiments. These figures show dearly large reductions in wear for various treatments when compared to the nitrogen standard.

Dramatic reductions in wear occur particularly for those vapors delivered at the highest temperatures. The effects at these higher temperatures are extraordinary—with wear reductions of 94%, 99%, and 99% for lauryl methacrylate, diallyl phthalate, and vinyl octadecyl ether vapors, respectively. A 99% reduction in wear means that the life of the rubbing elements has increased by 100-fold.

Figure 8:
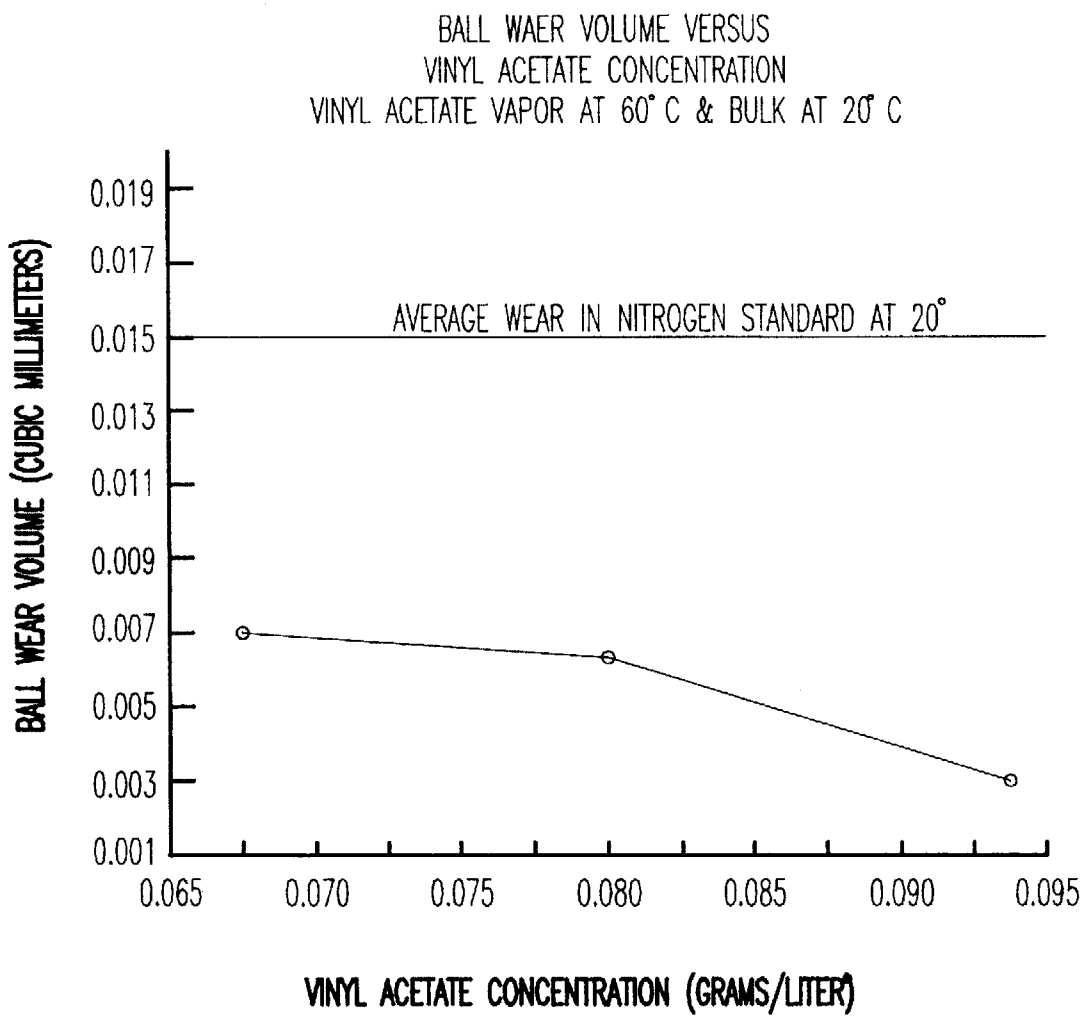
FIG. 8 is a graph of vinyl acetate vapor phase ball wear.

Vinyl acetate was also tested for alumina-on-alumina ball wear reduction at a bulk temperature of 20° C. and a vinyl acetate vapor temperature of 60° C. at several different concentrations of the monomeric compound, viz. at about 0.0675 g/l, 0.0788 g/l, and 0.0938. The results are graphically shown in FIG. 8. The results show significant wear reduction achieved with vinyl acetate used as the monomeric compound.

Total Wear

Figure 5:
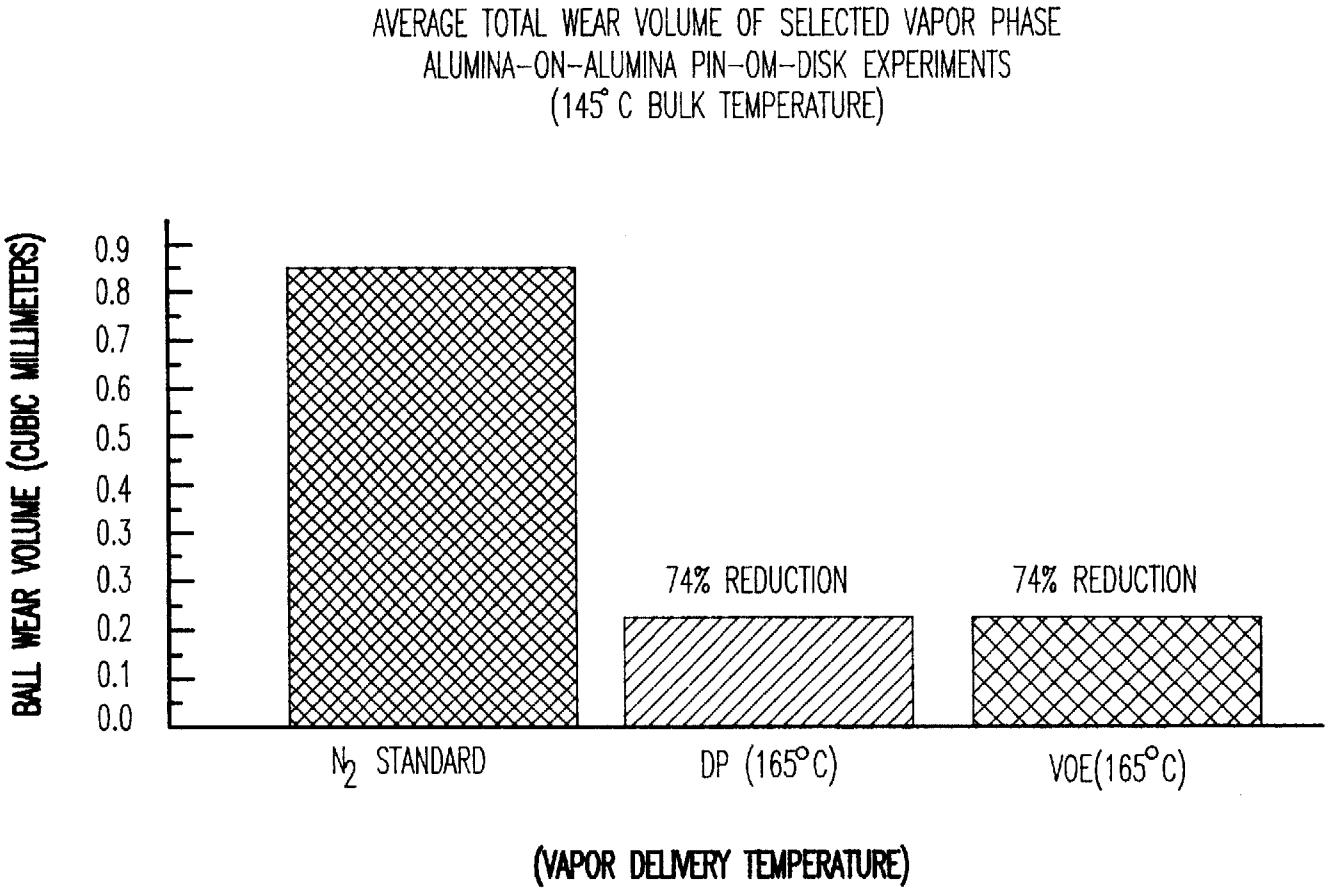
FIG. 5 is a chart of average total wear volume of selected vapor phase experiments.

Analysis of disk wear volumes provides additional solid evidence that the compounds tested of lauryl methacrylate, diallyl phthalate, and vinyl octadecyl ether, significantly reduce wear. FIG. 5 illustrates the effectiveness of the tested compounds. This figure clearly shows that the compounds reduce total (ball and disk) ceramic wear with reductions ranging from 74 to 92%.

Monomer Vapor Concentration and Temperature Effects

Examination of concentration data revealed some interesting observations. Very low concentrations of compound vapor provided substantial reductions in wear. Any additional benefits resulting from higher monomer vapor concentrations were small. A summary of the concentrations and observed ball wear reductions is given in Table 2.

TABLE 2

Summary of Delivery Temperature and Concentration Effects

| Treatment (Compound Delivery Temperature) | Boiling point (°C.), @ 5 mm Hg | Range of Concentration (g/l) | Range of Concentration ($10^{-5}$ moles/l) | Average % Ball Wear Reduction |
|---|---|---|---|---|
| Nitrogen Standard | — | — | — | 0 |
| Diallyl Phthalate (135° C.) | 165–167 | 0.0065–0.0066 | 2.64–2.67 | 35% |
| Diallyl Phthalate (165° C.) | 165–167 | 0.0065–0.0143 | 2.64–5.81 | 99% |
| Lauryl Methacrylate (120° C.) | 142 | 0.0050–0.0055 | 1.96–2.16 | 48% |
| Lauryl Methacrylate (140° C.) | 142 | 0.0051–0.0186 | 2.00–7.31 | 94% |
| Vinyl Octadecyl Ether (130° C.) | 147–187 | 0.0009–0.0010 | 0.30–0.34 | 45% |
| Vinyl Octadecyl Ether (130° C.) | 147–187 | 0.0042–0.0043 | 1.42–1.45 | 73% |
| Vinyl Octadecyl Ether (130° C.) | 147–187 | 0.0045–0.0092 | 1.52–3.10 | 99% |

Boiling points specified by the manufacturer (Aldrich Chemical Company) of each compound listed in Table 2 are also given in Table 2.

Figure 6:
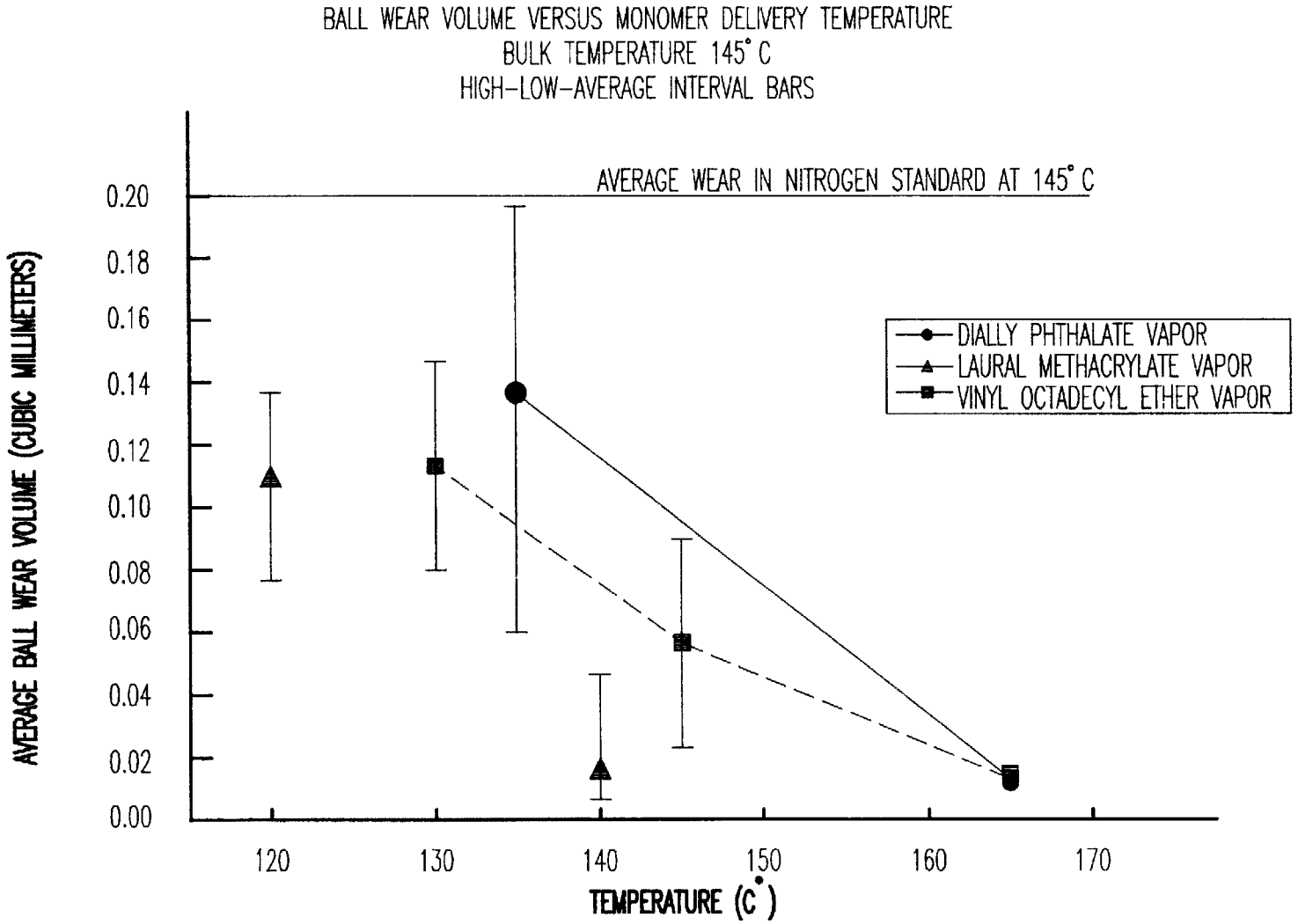
FIG. 6 is a graph of average ball wear volume compared to compound delivery temperature.

It was observed with interest that as each compound was delivered at a higher temperature it became successively more effective in reducing wear. Although these higher delivery temperatures do increase vapor concentrations in the nitrogen carrier, the results suggest that delivery temperature and not concentration is the dominant factor in increased effectiveness in reducing wear. This effect occurred with all compounds tested and is illustrated by FIG. 6. FIG. 6 graphically summarizes the ball wear volumes observed versus the compound delivery temperature for diallyl phthalate vapor (●); lauryl methacrylate vapor (▲); and vinyl octadecyl ether vapor (■).

Friction

Figure 7:
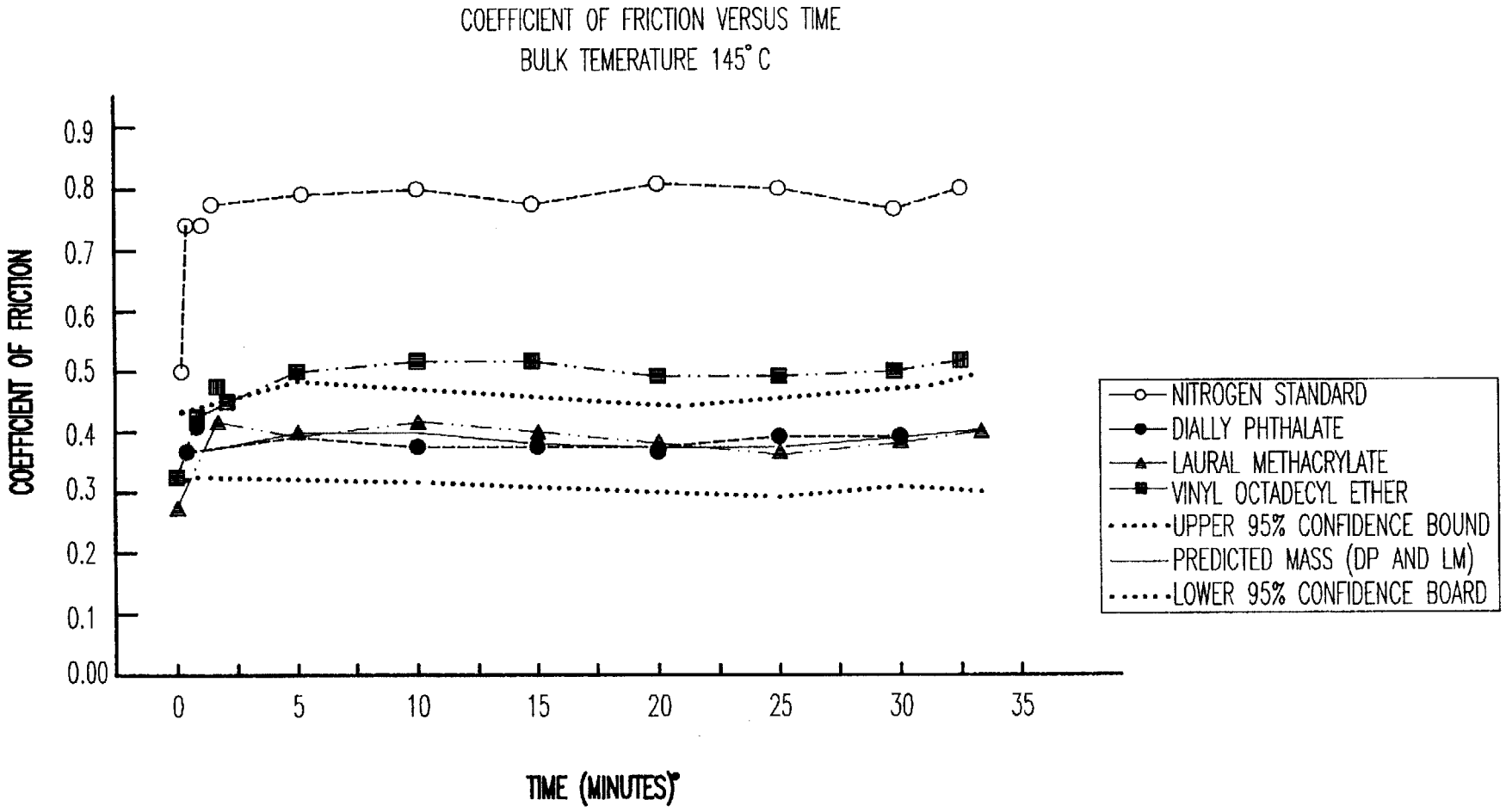
FIG. 7 is a graph of the coefficient of friction over time.

Results regarding the frictional characteristics of vapor phase lubrication show consistent trends as seen in FIG. 7, showing data observed for a nitrogen standard (○); diallyl phthalate vapor (●); lauryl methacrylate vapor (▼), and vinyl octadecyl ether vapor (■). At ambient bulk temperature (20° C.), the coefficient of friction for nitrogen is approximately 0.4. At 145° C. bulk temperatures, the coefficient of friction for the nitrogen standard is around 0.8. Under these conditions, vinyl octadecyl ether vapor reduced friction coefficients to 0.5 while both diallyl phthalate and lauryl methacrylate vapor reduced friction coefficients to 0.4. This shows that the experimental compounds reduced ceramic friction by approximately 37–50% at higher temperatures. These are significant and large effects.

The examples presented clearly demonstrate that our vapor phase approach to lubrication of a ceramic surface is not only extremely effective in reducing wear but in reducing friction as well. And the beneficial effects are more pronounced at higher temperatures. Also, although each of the examples given above use compounds having the general structure of formula (I) described herein, i.e., $CH_2{=}C(R_1)R_2$ where $R_2$ contains an oxygen atom, the detailed mechanisms associated with the double bond are by no means fully understood yet. However, there is clear evidence nonetheless of surface film formation on the wear tracks of the alumina disks used in these vapor phase experiments. Surface analysis of disk wear tracks using Fourier Transform Infrared Microspectrometry indicated the presence of alumina soaps or complexes from chemical reaction with the ceramic surfaces. While not desiring to bound to any particular theory at this time, it is theorized that it is also possible that the monomers of this invention function by first reacting chemically to form a metallic soap or complex and then proceeding to form oligomers or polymers growing outward from the contact surface. This would create a strong bond to the solid surface, with the initial complex formation serving as an "anchor" for the extended oligomeric/polymeric protective film.

Although the inventive gas phase lubrication method was exemplified above by way of rubbing ceramic surfaces, it is also contemplated that this invention is favorably applicable to metal alloys and metals (such as steels) having a surface in rubbing contact with another surface, such as those encountered in high temperature processes (e.g., metal engines, or bearings). It is also contemplated that the invention is applicable to lubrication of a ceramic surface in rubbing contact with metal surfaces, and vice versa.

While the present invention has been described in terms of its preferred embodiment where certain monomer compounds have been used as introduced in a gas phase to reduce wear of rubbing components, those skilled in the art will recognize that the invention can be practiced with modification within the spirit and scope of the appended claims.

Having described our invention, what we claim as new and desire to secure by Letters Patent is the following:

What is claimed is:

1. A method of reducing wear, comprising the steps of:

providing a first solid material having a first surface which will be exposed to rubbing contact with a second surface of a second solid material, wherein said first solid material and said second material are each independently selected from the group consisting of ceramic materials, metallic materials, and composite materials;

contacting at least said first surface of said first solid material with a lubricating gaseous composition comprising monomers in a gaseous state dispersed in a carrier gas, wherein said monomers are selected from the group consisting of alkyl methacrylates, alkyl acrylates, vinyl esters, vinyl alkyl ethers, allyl esters of alkyl acids, allyl esters of aryl acids, diallyl esters of alkyl acids, diallyl esters of aryl acids, divinyl esters of alkyl acids, divinyl esters of aryl acids, triallyl esters of alkyl acids, triallyl esters of aryl acids, trivinyl esters of alkyl acids, and trivinyl esters of aryl acids;

providing said rubbing contact between said first solid material and said second solid material in a manner subjecting said lubricating gaseous composition to tribological conditions whereby said lubricating gaseous composition reduces wear and friction of at least one of said first solid material at said first surface and said second solid material at said second surface exposed to rubbing contact.

2. A method as in claim 1 wherein said carrier gas is selected from the group consisting of air, nitrogen, and hydrocarbon combustion gases.

3. A method as in claim 1 wherein, prior to said contacting step, heating said monomers to form said vapor phase thereof, and introducing said vapor phase into a flowing stream of inert gas as said carrier gas.

4. A method as in claim 1 wherein, prior to said contacting step, injecting said monomers in liquid form into a stream of said carrier gas vaporizing said monomers.

5. A method as in claim 1 wherein, prior to said contacting step, adjusting pressure and temperature of said monomers and said carrier gas such that said monomers are present as said vapor phase in said carrier gas.

6. A method as in claim 1 wherein said monomers comprise diallyl phthalate.

7. A method as in claim 1 wherein said lubricating gaseous composition comprises said monomers in a total amount of 0.001 to 0.02 g/l of said gaseous composition.

8. The method of claim 1 wherein said first solid material is a ceramic material.

9. The method of claim 8 wherein said second solid material is a ceramic material.

10. The method of claim 1 wherein said first solid material is a metallic material.

11. The method of claim 10 wherein said second solid material is a ceramic material.

12. The method of claim 1 wherein said first solid material is a ceramic material selected from the group consisting of alumina, zirconia, silicon nitride, silicon carbide, boron nitride, aluminum nitride, boron carbide, beryllia, and combinations thereof.

13. The method of claim 1 wherein said first solid material is a metal selected from the group consisting of steel, alloy steels, alloy cast iron, aluminum alloys, and titanium alloys.

14. The method of claim 1 further comprising additionally contacting said second surface of said second solid material with said lubricating gaseous composition comprising said monomers dispersed in a carrier gas.

15. The method of claim 1 wherein, during said step of providing rubbing contact, said first solid material is stationary while said second solid material is in relative motion thereto.

16. The method of claim 1 wherein, during said step of providing rubbing contact, said second solid material is stationary while said first solid material is in relative motion thereto.

17. The method of claim 1 wherein, during said step of providing rubbing contact, said second solid material and said first solid material are nonstationary and in motion relative to each other.

18. A method as in claim 1 wherein said lubricating gaseous composition comprises said monomers present at a partial pressure below saturation pressure in said gaseous composition.

19. A method of reducing wear, comprising the steps of:

providing a first solid material having a first surface which will be exposed to rubbing contact with a second surface of a second solid material, wherein said first solid material and said second material are each independently selected from the group consisting of ceramic materials, metallic materials, and composite materials;

contacting at least said first surface of said first solid material with a lubricating gaseous composition comprising monomers in a gaseous state dispersed in a carrier gas, wherein said monomers are selected from the group consisting of diallyl phthalate, diallyl succinate, diallyl sebacate, triallyl trimesate, n-butyl methacrylate, hexyl methacrylate, lauryl methacrylate, n-octadecylmethacrylate, iso-decyl acrylate, n-butyl acrylate, hexyl acrylate, lauryl acrylate, n-octadecylacrylate, vinyl acetate, vinyl propionate, vinyl octoate, vinyl 2-ethylhexanoate, vinyl stearate, vinyl hexyl ether, and vinyl octadecyl ether;

providing said rubbing contact between said first solid material and said second solid material in a manner subjecting said lubricating gaseous composition to tribological conditions, whereby said lubricating gaseous composition reduces wear and friction of at least one of said first solid material at said first surface and said second solid material at said second surface exposed to rubbing contact.

* * * * *